US005169017A

United States Patent [19]

Cooper et al.

[11] Patent Number: 5,169,017

[45] Date of Patent: Dec. 8, 1992

[54] CAN END CLOSURE APPARATUS

[75] Inventors: Terry Cooper, Danville; Walter Lum; Peter Douglas, both of Bloomsburg, all of Pa.

[73] Assignee: H. J. Heinz Company, Pittsburgh, Pa.

[21] Appl. No.: 808,078

[22] Filed: Dec. 11, 1991

Related U.S. Application Data

[63] Continuation of Ser. No. 579,170, Sep. 5, 1990, abandoned.

[51] Int. Cl.[5] ..... B65D 17/20

[52] U.S. Cl. ..... 220/273; 220/619; 206/509; 206/508

[58] Field of Search ..... 220/273, 610, 619, 689; 206/508, 509

[56] References Cited

U.S. PATENT DOCUMENTS

| | | | |
|---|---|---|---|
| 794,880 | 7/1905 | Page . | |
| 2,004,946 | 6/1935 | Hothersall | 220/43 |
| 2,119,533 | 6/1938 | Fink | 220/43 |
| 2,523,285 | 9/1950 | Erb | 220/48 |
| 2,621,826 | 12/1952 | Sebell | 220/27 |
| 2,663,455 | 12/1953 | Sebell | 220/27 |
| 2,772,808 | 12/1956 | Fried | 220/48 |
| 3,115,985 | 12/1963 | Fried | 220/48 |
| 3,302,823 | 2/1967 | Hulse | 220/54 |
| 3,400,852 | 9/1968 | Khoury | 220/54 |
| 3,401,824 | 9/1968 | Rouse | 220/54 |
| 3,441,171 | 4/1969 | Stec | 220/54 |
| 3,478,918 | 11/1969 | Zundel | 220/54 |
| 3,762,596 | 10/1973 | Henning et al. | 220/54 |
| 3,838,788 | 10/1974 | Stargell | 220/54 |
| 3,874,553 | 2/1975 | Schultz et al. | 220/273 |
| 3,905,514 | 9/1975 | Dragomier et al. | 220/273 |
| 4,003,495 | 1/1977 | Grise et al. | 220/268 |
| 4,044,916 | 8/1977 | Beveridge | 220/270 |
| 4,345,696 | 8/1982 | Guimarin | 220/277 |
| 4,394,927 | 7/1983 | Zysset | 220/273 |
| 4,524,879 | 6/1985 | Fundom et al. | 220/273 |
| 4,643,329 | 2/1987 | Mobberley et al. | 220/257 |
| 4,660,735 | 4/1987 | Peschardt et al. | 220/276 |
| 4,669,629 | 6/1987 | Saunders | 220/273 |
| 4,759,464 | 7/1988 | Taniuchi | 220/273 |

*Primary Examiner*—Joseph Man-Fu Moy

[57] ABSTRACT

The can end closure member includes a removable central panel for opening the can, and a stepped panel portion allowing the can to be opened by means of a conventional can opener. The stepped panel portion has an angled configuration which recesses the scoreline of the central panel and protects the scoreline from shocks during shipping and handling. The stepped panel portion also includes a ledge portion which serves as a seat for stacking another can on the stepped panel portion without bearing upon the scoreline or the central panel.

3 Claims, 3 Drawing Sheets

FIG. 7
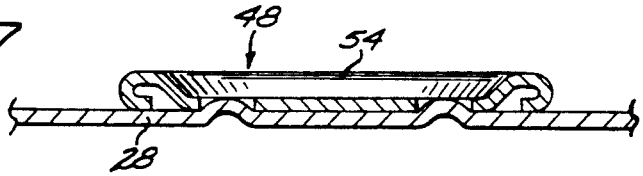
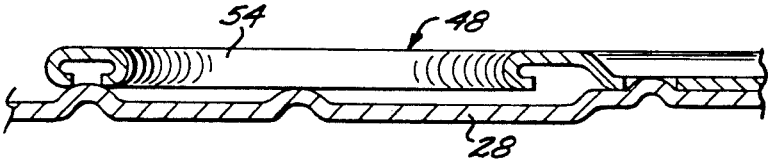
FIG. 8
FIG. 9
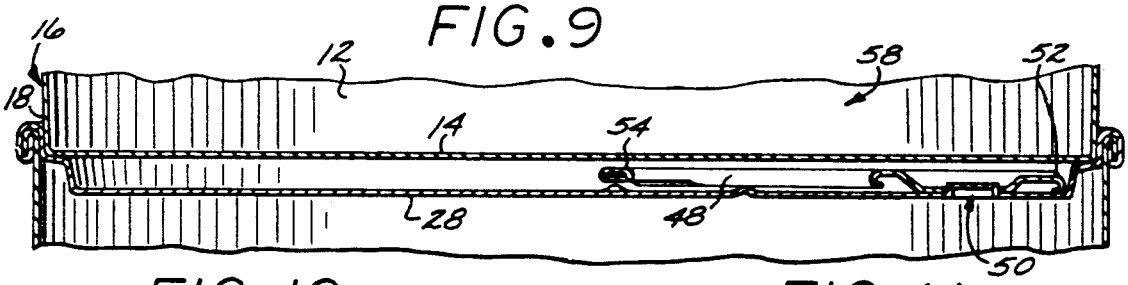
FIG. 10
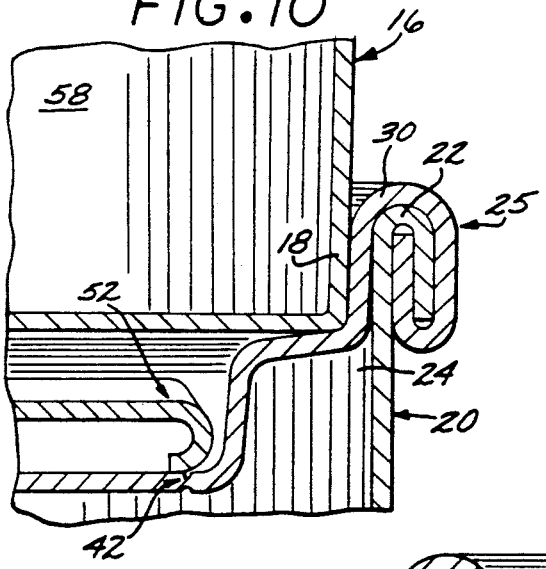
FIG. 11
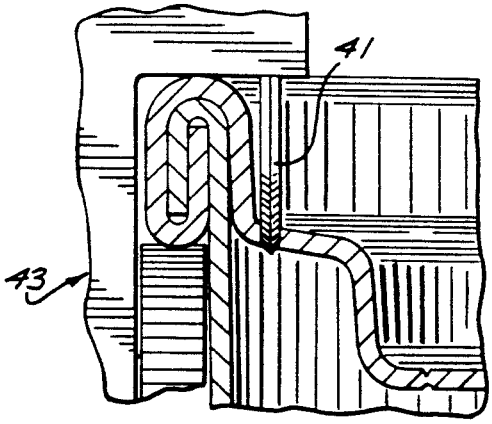
FIG. 12
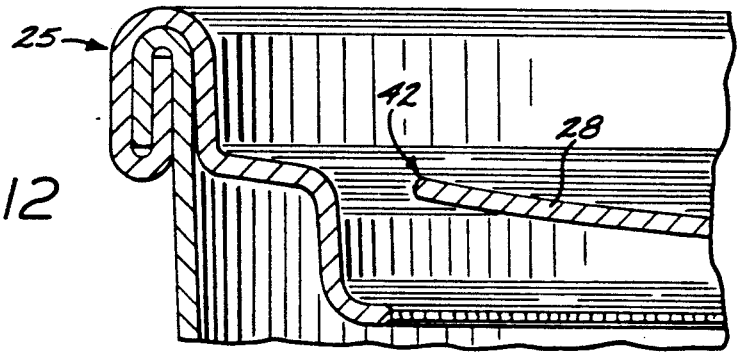

CAN END CLOSURE APPARATUS

This is a continuationof copending application Ser. No. 07/579,170, filed on Sept. 5, 1990, now abandoned.

BACKGROUND OF THE INVENTION

1. Field of the Invention

This invention generally relates to hermetically sealed cans with a removable can end panel for easy opening, and more particularly relates to a stackable, hermetically sealed, easy opening food product can with a removable pull-tab panel that may also be opened with a conventional can opener.

2. Description of Related Art

The ease with which food containers may be opened, and the strength and structural integrity of such containers in preserving freshness and flavor of the contents are significant factors to consumers and the canned food industry alike. The common "sanitary", hermetically sealed can has a design which is structurally suited for stacking, shipping and handling, but typically must be opened with a conventional can opener. The can lid is generally secured to the body of the can with a double or "chime" seam of a standard height and width to accept a standard can opener for cutting through the lid to open the can. With the advent of cans with removable can lid seams which could be opened with a key provided with the can, and removable pull tab panels, the consumer was freed from the necessity of using a separate can opener device for opening such food cans. Unfortunately, the configuration of the seams of such specialized cans often prevented opening of the cans with standard can openers.

The so-called "easy opening" cans have a lid with a scoreline of reduced thickness to define a removable panel, and have a pull tab or handle attached to the panel for tearing at least a part of the panel free from the can. However, the scorelines of such full panel, easy open cans have a tendency to fracture during shipping, especially when such cans are stacked one upon the other so that the weight of the stacked cans may exert considerable force to break the scoreline of a can lid.

In order to reduce some of the stresses on the scored can end panels during shipping, the "raised panel" design illustrated in FIGS. 1–3 was developed, in which a U-shaped trough was formed in the panel between the seam and the scored portion of the panel to allow the panel to flex, in order to cushion the panel against shocks that occur during shipping and handling. However, the existence of a trough around the inside of the seam of the lid prevents opening of the can with a conventional can opener. Since it is often difficult for individuals such as the aged or the infirm to open the pull tab, full panel cans, manufacturers frequently make both the easy-open type of can and the "sanitary" type of can for the same food products. It would therefore be desirable to provide an easy-open type of can which would withstand the rigors of stacking, shipping, and handling, and which can also be opened with a conventional can opener.

In addition, the thickness and configuration of an easy-open can lid is important for preventing the scoreline from fracturing due to the heat and pressures which develop within the can during sterilization of the processed foods stored in the can. It would therefore also be desirable to provide an easy open can lid with a configuration with improved strength which would allow the scoreline to withstand internal pressures during canning procedures, which would allow reduction of the thickness and diameter of the sheet metal used in forming the can lid, and reduction in the thickness of the scoreline to facilitate easier opening of the full panel, pull tab can lid.

SUMMARY OF THE INVENTION

Briefly, and in general terms, the present invention provides an improved can end closure member having a removable central panel for opening the can, and having a stepped panel portion at the top edge of the can allowing the can to be opened by means of a conventional can opener. The stepped panel portion has a double angle configuration which recesses the scoreline of the central panel and protects the scoreline from shocks during shipping and handling. The stepped panel portion also includes a ledge portion which may serve as a seat for the bottom end of another can, to allow one or more cans to be stacked on top of the stepped panel portion so that the weight of the stack does not rest upon the central panels or scorelines of any of the cans in the stack.

The can end closure member is particularly adapted for cans for containing processed foods,such as pet foods, or other types of canned meat or fish, which would typically be sterilized at elevated temperatures as a part of the canning process. The end closure member includes a generally planar sheet metal member formed to have a generally planar central wall panel, and a peripheral seam flange adapted for forming a seal with the edge seam flange of the can body. The planar sheet metal member also includes a stepped panel portion including at least two steps extending between the central wall panel and the peripheral seam flange. The stepped panel portion preferably includes a first sidewall portion extending toward the central wall panel from the peripheral seam flange generally perpendicular to the plane of the central wall panel, a ledge portion extending from the first sidewall portion generally parallel to the plane of the central wall panel, and a second sidewall portion extending generally perpendicular to the plane of the central wall panel from the ledge portion to an outer edge portion of the central wall panel. The central wall panel is thus recessed in a direction away from the plane of the peripheral seam flange. The planar sheet member also includes a scoreline of reduced thickness formed in the surface of the central wall panel at the outer periphery of the central wall panel adjacent the second sidewall portion, and preferably includes a pull tab member on the central wall panel for fracturing the scoreline, so that the central wall panel may be removed to form a can access opening in the end closure member.

The invention also provides for a stackable easy-open can having an upper end sealed by the end closure member, and a closed bottom end having a diameter less than the diameter of the first sidewall portion of the end closure member and greater than the diameter of the second sidewall portion, such that the bottom of one can is adapted to be seated on the ledge portion of the closure member of another can without bearing upon the central wall panel or scoreline of the can underneath.

These and other aspects and advantages of the invention will become apparent from the following detailed description, and the accompanying drawings, which illustrate by way of example the features of the invention.

BRIEF DESCRIPTION OF THE DRAWINGS

FIG. 7 is an enlarged sectional view of the pull tab of the can end closure member taken along line 7—7 of FIG. 4;

FIG. 8 is an enlarged partial sectional view of the pull tab of the can end closure member taken along line 8—8 of FIG. 4;

FIG. 9 is a cross-sectional view taken along line 9—9 of FIG. 4 showing the bottom of a can stacked on top of another can with the can end closure apparatus attached;

FIG. 10 is an enlarged cross-sectional view of a portion of the bottom edge of a can stacked on top another can with the can end closure apparatus attached;

FIG. 11 is an enlarged cross-sectional view of a can with the can end closure member attached being cut open with a can opener;

FIG. 12 is an enlarged cross-sectional view of a can with the can end closure member attached showing opening of the can by removing the easy-open central wall panel;

DETAILED DESCRIPTION OF THE PREFERRED EMBODIMENT

Figure 1:
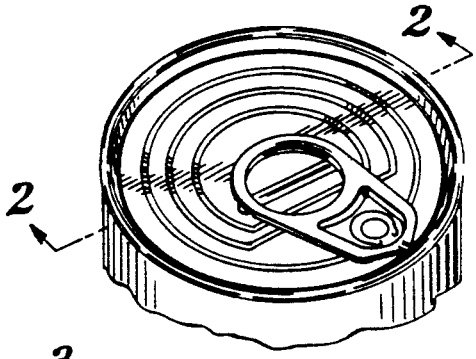
FIG. 1 PRIOR ART
FIG. 1 is a top perspective view of a prior art raised panel easy open can lid.
Figure 3:
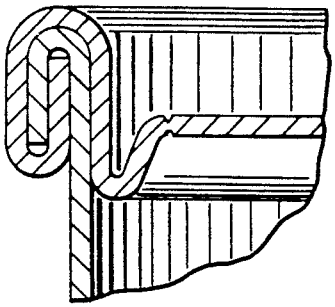
FIG. 3 PRIOR ART
FIG. 3 is an enlarged view of a section of the edge of the prior art can lid.
Figure 2:
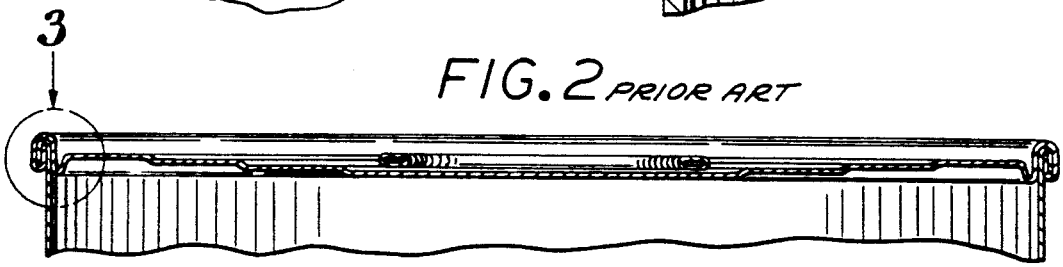
FIG. 2 PRIOR ART
FIG. 2 is a cross-sectional view of the prior art can lid of FIG. 1 taken along line 2—2.

As is shown in the FIGS. 4–12, which are provided for purposes of illustration and not by way of limitation, the invention is embodied in a can end closure member 10 for sealing a can which is preferably adapted for containing processed foods, and is preferably adapted to withstand the heat and pressure normally developed within the can during sterilization procedures. When secured to the can, the end closure provides a conventional "sanitary" double seam profile, to allow the can to be opened by a conventional can opener, and also provides a recessed, removable full panel for easy opening.

The can includes a body 12 with a bottom panel 14, a generally tubular sidewall portion 16 having a lower end portion 18 integrally connected to the bottom panel, and an upper end portion 20 having an upper edge seam flange 22 defining an upper opening 24 in the can body. The end closure apparatus is adapted to be secured to the edge seam flange with a double, or "chime" seam 25. The double edge seam typically also includes a rubber sealing compound between the edge seam flanges of the can body and closure member, to insure that the can seal is airtight.

The can end closure member is preferably formed from a generally planar sheet metal blank or shell 26 cut from a strip of sheet metal, which is preferably steel coated with tin, although tin free steel coated with chromium, or other metals such as aluminum or combinations of metals may also be suitable. In addition, the inner surface of the metal blank may be coated with an aluminized vinyl, such as VALSPAR. The sheet metal blank is typically formed in a dye stamping machine to have a generally planar central wall panel 28. The central wall panel is preferably symmetrically shaped, conforming to the shape of the top of the can, which is most typically round. However, the present invention is also suitable for cans of other shapes, such as oval or rectangular shaped cans, and even some unsymmetrically shaped cans may also be suitable. The end closure member includes a peripheral seam flange 30 formed to have a curvature and width particularly suited for forming the double seam seal 31 when crimped with the can body edge seam flange.

Figure 13:
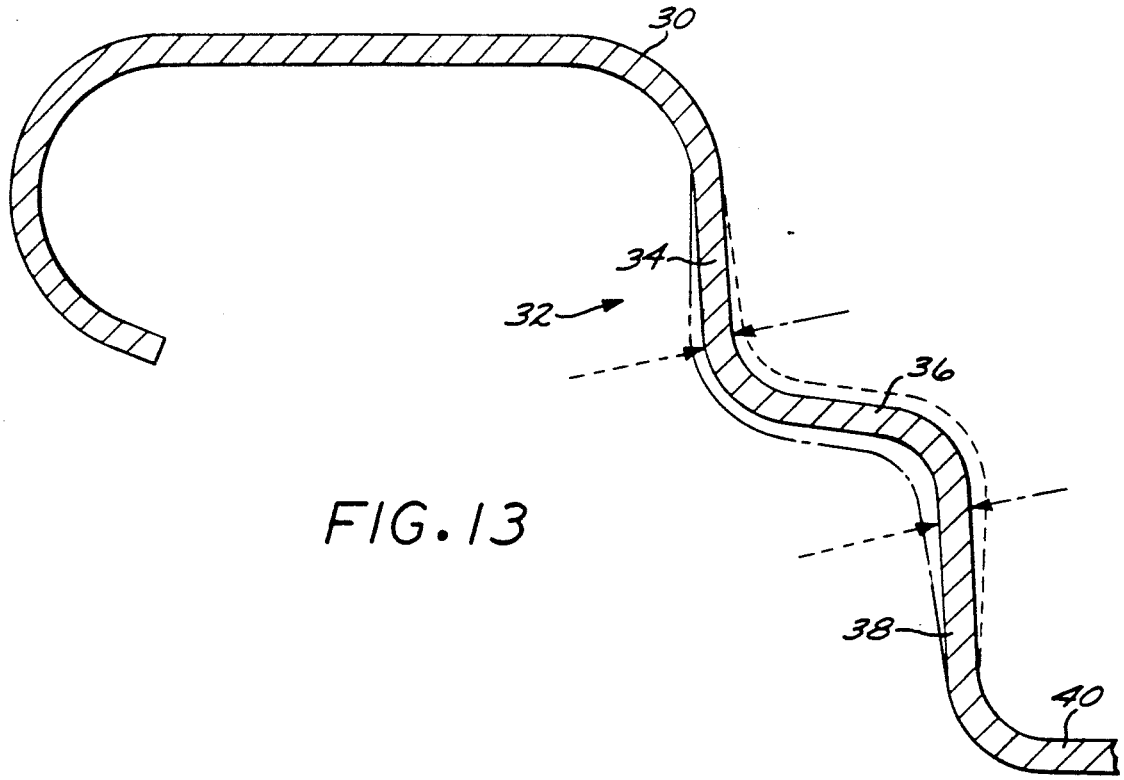
FIG. 13 is an enlarged view of the section of the edge of the can end closure member before it is sealed to a can body, showing flexing of the stepped panel portion.
Figure 14:
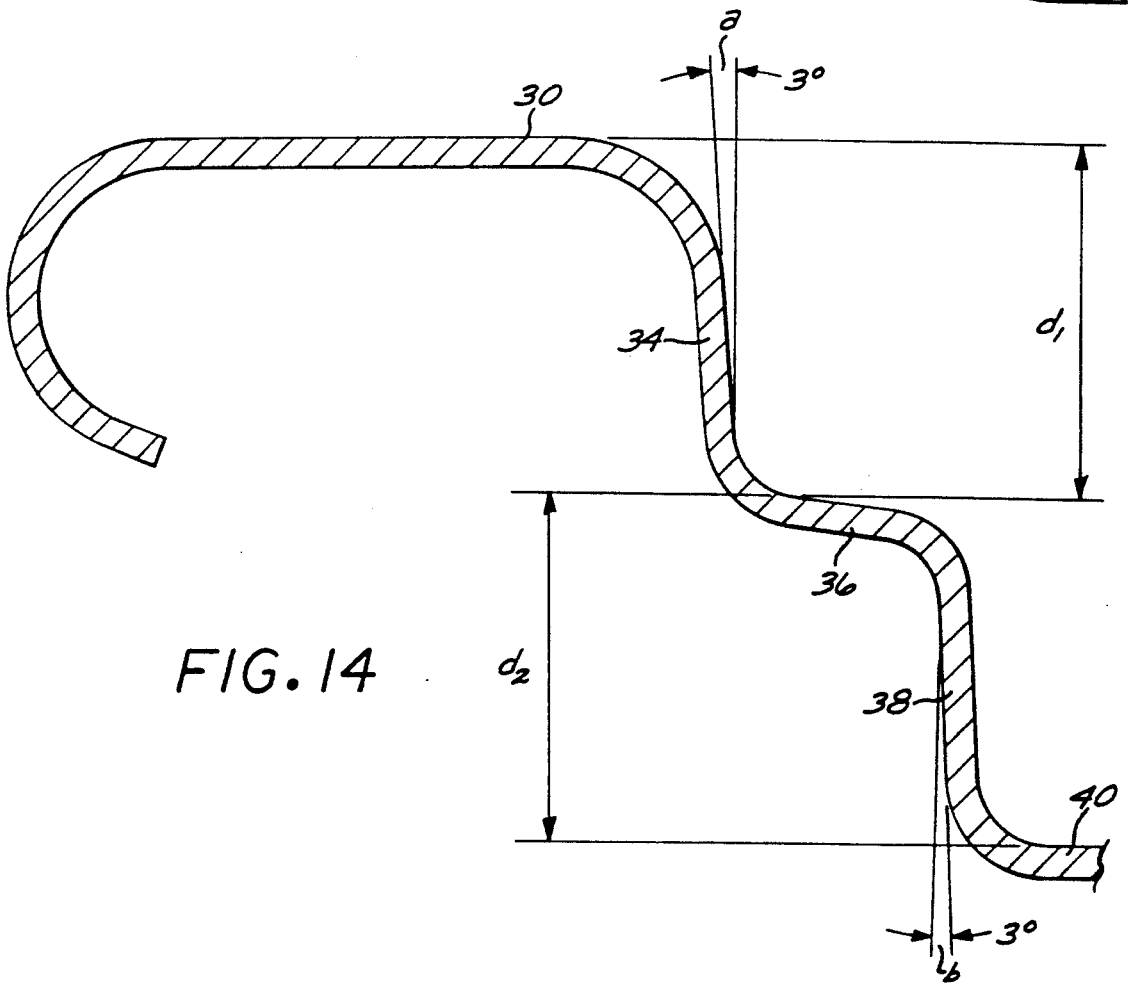
FIG. 14 is a view similar to that of FIG. 13 showing the angles of formation of the sidewall panels of the stepped panel portion of the can end closure member.

Referring to FIG. 14, an angled, stepped panel portion 32 extends between the central wall panel and the peripheral seam flange, and preferably includes a first, upper annular sidewall panel 34 having an inner diameter of about 3.27 inches, for example, and extending perpendicular to the central wall panel, and preferably at an acute angle to the plane of the central panel which is at an angle a of about 3° less than perpendicular to the central panel, and downward preferably by a distance ($d_1$) of about 0.114 inches toward the central wall panel from the peripheral seam flange. The upper annular sidewall thus forms a slightly tapered opening for receiving a similarly tapered bottom end of another can. A counter sunk ledge portion 36 adapted to be cut by a can opener, extends radially inward about 0.146 inches, for example, from the first sidewall panel, generally parallel to the plane of the central wall panel. A second lower annular sidewall panel 38 having an inner diameter of about 3.124 inches, for example, also extends downwardly by a distance ($d_2$) of about 0.094 inches, for example, and slightly less than perpendicular to the plane of the central wall panel, and preferably at an acute angle to the plane of the central panel which is at an angle b of about 3 less than perpendicular to the central panel, from the ledge portion to the outer edge portion 40 of the central wall panel. The first sidewall panel thus forms a first vertical step to the ledge portion, and the second slightly angled sidewall panel forms a second vertical step to the central wall panel. The central wall panel is preferably recessed from the plane of the peripheral seam flange by about 0.208 inches, for example, to protect the central wall panel from abrasions during shipping and handling. The flexible angled configuration of the stepped portion also can flex in the directions of the arrows shown in FIG. 13 to absorb shocks in order to help to protect the central wall panel from such shocks during shipping and handling. The stepped portion could also include additional steps to further isolate the central wall panel from shocks. The ledge of the stepped portion also provides a shoulder which can be cut open with the blade 41 of a conventional can opener 43, as shown in FIG. 11, and which is also useful for supporting another can, to facilitate stacking of such cans, as will be further described below.

Figure 4:
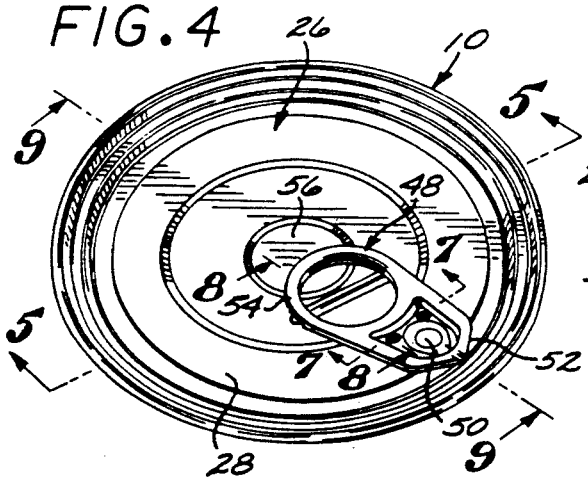
FIG. 4 is a top perspective view of the can end closure apparatus of the invention.
Figure 6:
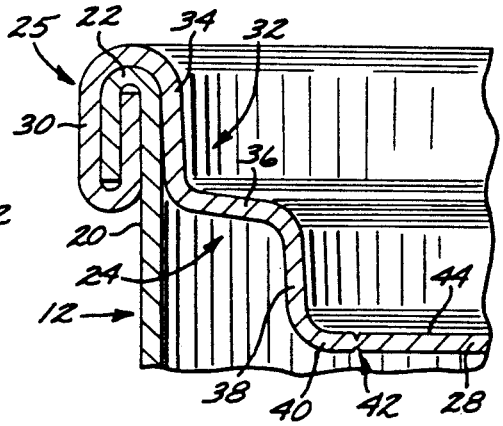
FIG. 6 is an enlarged view of a section of the edge of the can end closure member attached to a can body.
Figure 5:
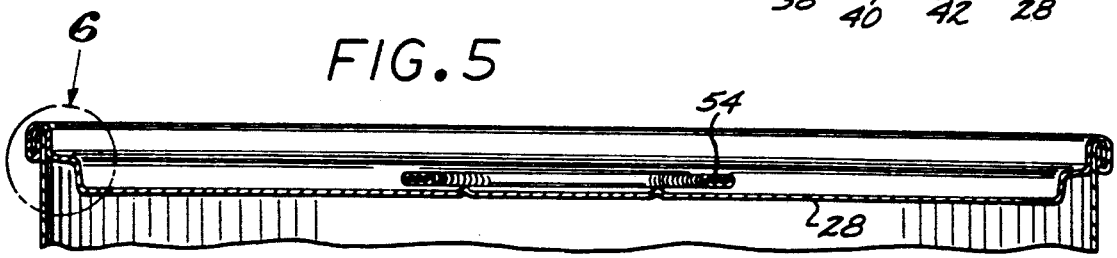
FIG. 5 is a cross-sectional view of the can end closure apparatus taken along line 5—5 of FIG. 4, and shown attached to a can body.

With reference to FIGS. 6, 10 and 12, a scoreline 42 of reduced thickness is also preferably formed in the surface 44 of the central wall panel along the outer periphery 46 of the central wall panel adjacent to the second sidewall panel. As is shown in FIGS. 7–9, a pull tab 48 is preferably secured to the central wall panel by a rivet 50 formed in the central wall panel. In the process of manufacturing the can, the rivet is typically formed in the central panel, and the pull tab is attached prior crimping of the double seam seal. The recessing of the central panel thus further protects the scoreline from fracturing by separating the scoreline and the pull tab from the can seam flanges during the double seaming process. Once the closure member is secured to the can body, the pull tab serves as a handle for pulling the central panel free from the rest of the can end closure member to open the can. The pull tab also preferably has a digger nose 52 at one end of the pull tab adjacent the scoreline, for fracturing the scoreline when the handle portion 54 at the other end of the pull tab is raised. A depression or finger well 56 is preferably also formed in the approximate center of the central panel, allowing an individual to more easily place a finger or fingernail under the pull tab handle for removal of the central panel. As can be seen in FIGS. 4, 7 and 8, the central panel may also be formed with raised features such as the raised points shown in FIG. 7 which prevent the pull tab from turning and keep the pull tab digger nose aligned with the scoreline, and the ridge under the handle portion shown in FIG. 8, which maintains the handle a small distance from the central panel to allow the handle to be more easily grasped.

It should be recognized that due to the inwardly recessed configuration of the stepped portion of the end closure member of the invention, the diameter of the central panel is proportionally smaller than the central panel of a raised panel type of can lid of the same diameter. The protection from external contacts and shocks afforded to the scoreline and central panel by recessing the central panel with the double angle stepped configuration, in combination with the improved strength of the scoreline on the central panel due to the reduced diameter of the central panel, allow a significant reduction in the thickness of the base sheet metal used in forming the end closure, from 85# tin plate or tin free steel to 75# or less, for example. The increased strength of the scoreline of the central panel resulting from its reduced diameter also permits the development of stronger vacuums in the interior of the can, which is particularly useful in the preservation of processed foods. Thus, for example, whereas a typical can with a raised panel closure of 75# plate may be able to withstand a vacuum of up to about 12 inches of mercury, a can with the new stepped panel closure of the invention can withstand a vacuum of up to about 20 inches of mercury or more. Typically, a raised panel type of closure would need to be formed with 85# plate to withstand a vacuum of 20 inches of mercury. The improved strength of the scoreline of the central panel also allows the scoreline to be formed with a further reduced thickness to facilitate easier opening of the can. In addition, the radial length of sheet metal in the stepped portion of the closure member is less than that for the trough portion of a raised panel closure for the same size can, so that the diameter of the sheet metal blank used in forming the end closure member of the invention can typically be reduced from about 4.025 inches to about 3.985 inches. Thus, the reductions in thickness and diameter of the sheet metal blank which are possible in manufacturing the closure member of the invention can result in significant cost savings in the manufacturing process.

As can be best seen in FIGS. 9 and 10, the bottom end of a can with the can closure member attached also preferably has a closed bottom end panel having an outside diameter less than the inside diameter of the first sidewall portion of the end closure member and greater than the inside diameter of the second sidewall portion, such that the bottom of a second can 58 formed in this manner may be seated on the ledge portion of the closure member, so that the bottom of the can does not bear upon the central wall panel or scoreline of the can underneath. Thus, cans having the end closure member of the invention and the bottom end portion adapted to interfit with the ledge portion of the closure member are readily stackable in a fashion which prevents fracturing of the scorelines of the central wall panels of the cans.

From the foregoing, it will be appreciated that the present invention provides an easy-open type of can which can be opened by removal of a pull tab panel, and which can also be opened with a conventional can opener. The present invention also provides an easy open can end closure having a configuration which allows the scoreline to better withstand the rigors of shipping and handling, and internal pressures developed during canning procedures. The configuration of the closure member further allows reduction of the thickness and diameter of the sheet metal used in forming the can closure member, and reduction in the thickness of the scoreline to facilitate easier opening of the full panel, pull tab lid. It is also significant that the configuration of the closure member permits convenient and safe stacking of cans having the end closure member of the invention and a bottom end dimensioned to be seatable on the ledge of the stepped portion of the closure member.

While particular forms of invention have been illustrated and described, it will be apparent that various modifications can be made without departing from the spirit and scope of this invention. Accordingly, it is not intended that the invention be limited, except as by the appended claims.

What is claimed is:

1. An easy-open stackable can for use with a second identical can, said easy-open can having a top adapted to be opened either by a can opener or by removal of a pull-tab center panel, comprising:

a can body having a closed bottom end, a sidewall portion having a first end connected to said bottom end and a second end having an edge seam flange defining an opening in said can body;

an end closure member secured to said can body edge seam flange, said closure member including a sheet metal member formed to have a generally planar central wall panel, a peripheral seam flange forming a seal with said can body edge seam flange, and a stepped panel portion extending between said central wall panel and said peripheral seam flange;

said stepped panel portion having a first sidewall portion extending inwardly at an angle slightly less than perpendicular to said central wall panel toward said central wall panel from said peripheral seam flange so as to define a space between said first sidewall portion and the upper interior surface of the sidewall portion of the can, a ledge portion extending inwardly from said first sidewall portion generally parallel to the plane of said central wall panel and engagable by a can opener, and a second sidewall portion extendign inwardly at an angle slightly less than perpendicular to said central wall panel from said ledge portion to an outer edge portion of said central wall panel, whereby said central wall panel is recessed in a direction away from said peripheral seam flange;

a scoreline of reduced thickness formed in the surface of said central wall panel at the outer peripheray of said central wall panel adjacent said second sidewall portion;

pull tab means on said central wall panel for fracturing said scoreline, whereby said central wall panel may be removed to form a can access opening in said end closure member;

said can bottom having a diameter less than the diameter of said first sidewall portion of said closure member and greater than the diameter of said second sidewall portion, such that the ledge portion of the closure member of a first said can is adapted to receive the can bottom of a second identical can, whereby the can bottom of said second can may be stacked on top of said first can without the weight of said second can bearing upon the central wall panel of said first can or upon said scoreline, and with the stepped panel portion flexing to absorb shocks applied by said second stacked can.

2. The can of claim 1 wherein said first and second sidewall portions extend inwardly at an angle of about 3 degrees less than perpendicular to said central wall panel.

3. The can of claim 1 wherein said can is adapted for containing processed foods.

* * * * *

UNITED STATES PATENT AND TRADEMARK OFFICE

CERTIFICATE OF CORRECTION

PATENT NO. : 5,169,017

DATED : December 8, 1992

INVENTOR(S) : Terry Cooper et al

It is certified that error appears in the above-identified patent and that said Letters Patent is hereby corrected as shown below:

In Claim 1, Column 7, line 4, after the word "portion" and before the word "inwardly", please delete [extendign] and insert extending.

Column 4, line 47;
after the word "angle" and before the word "of", please delete [b] and insert b.

Column 4, line 47;
after the word "about" and before the word "less", please delte [3] and insert 3°.

Signed and Sealed this

Second Day of November, 1993

Bruce Lehman

*Attest:*

BRUCE LEHMAN

*Attesting Officer*

*Commissioner of Patents and Trademarks*